United States Patent [19]

Suzuki et al.

[11] Patent Number: 4,969,487

[45] Date of Patent: Nov. 13, 1990

[54] SOLENOID VALVE

[75] Inventors: Katsuhiro Suzuki; Kozo Murayoshi, both of Gifu; Toru Yagasaki, Tochigi, all of Japan

[73] Assignee: Kayaba Industry Co., Ltd., Tokyo, Japan

[21] Appl. No.: 407,897

[22] Filed: Sep. 15, 1989

[51] Int. Cl.[5] ..... F15B 13/044

[52] U.S. Cl. ..... 137/625.65; 137/85

[58] Field of Search ..... 137/85, 625.65

[56] References Cited

U.S. PATENT DOCUMENTS 4,056,126 11/1977 Hauser ..... 137/625.65
4,396,037 8/1983 Wilcox ..... 137/625.65
4,478,250 10/1984 Lukasczyk ..... 137/625.65
4,615,358 10/1986 Hammond ..... 137/625.65 X
4,643,225 2/1987 Imkoff ..... 137/625.65 X

*Primary Examiner*—Alan Cohan
*Attorney, Agent, or Firm*—Koda and Androlia

[57] ABSTRACT

A solenoid valve is provided which is so constructed that reaction chambers are formed on both sides of a spool. Into the reaction chambers is introduced the loading pressure of an actuator to accomplish the balance between the pressing force of proportional solenoids and the reaction force of the reaction chambers, resulting in a control pressure applied to a cylinder being automatically adjusted depending on the loading pressure of the actuator.

1 Claim, 2 Drawing Sheets

SOLENOID VALVE

BACKGROUND OF THE INVENTION

This invention relates to a solenoid valve, and more particularly to a solenoid valve wherein a push rod provided at a solenoid pushes a spool arranged in a valve body for the changing-over.

A conventional solenoid valve of such type is generally constructed as shown in FIG. 4.

More particularly, the conventional solenoid valve indicated at reference character Vu is adapted to change over a spool section 3 depending on an excitation current supplied to a solenoid 1 or 2. When the spool section 3 is at a neutral position shown in FIG. 4, a pump passage 4 and a tank passage 5 communicate with each other in the solenoid valve Vu.

When the solenoid 1 is excited, the spool section 3 is changed over from the neutral position to a left-side position to communicate a pump P with a left-side chamber 6 of a cylinder C and communicate a right-side chamber 7 of the cylinder C with a tank T. This causes a piston 8 of the cylinder C to be moved in a right-hand direction in FIG. 4. When the other solenoid 2 is excited, the spool section 3 is changed over to a right-side position, resulting in the piston 8 of the cylinder C being moved in a left-hand direction.

When the excitation current of each of the solenoids 1 and 2 is controlled, the stroke of the spool section 3 is controlled and a control pressure acting on the cylinder C is controlled depending on the stroke of the spool section 3.

Unfortunately, in the conventional solenoid valve constructed as described above, the piston 8 of the cylinder C is caused to be substantially moved even when the stroke of the spool is determined by controlling the excitation current of the solenoid, so that an increase in flow demand of the cylinder causes the control pressure to be decreased correspondingly. FIG. 5 shows a decrease of the control pressure with an increase in flow demand of the cylinder C from $Q_1$ to $Q_3$.

Thus, a decrease of the control pressure acting on the cylinder C causes the responsibility between the operation of the solenoid valve and the operation of the cylinder to be deteriorated.

Also, as shown in FIG. 6, a variation in temperature of oil causes the control pressure to be varied. More particularly, when the temperature of oil is lowered, the viscosity of oil is raised. However, such an increase in viscosity causes the stroke of operation of the cylinder C to be increased as compared with the stroke of the spool section 3. On the contrary, when the temperature of oil is raised, the viscosity is lowered; however, such lowering of the viscosity causes the stroke of operation of the cylinder to be decreased relative to the stroke of the spool section 3.

Thus, the conventional solenoid valve fails to keep the control pressure applied to the cylinder C constant even when the stroke of the spool section 3 is kept constant. This causes the responsibility to be unstable.

A valve for solving the above-described problem is proposed in U.S. Pat. No. 2,996,136, although it is not a solenoid valve. The proposed valve is used for a servo steering mechanism for a motor and includes a spool and two control pins slidably inserted in both sides of the spool. One end of each of the control pins is abutted against a valve body and the other end is associated with a reaction chamber formed in the spool. To the reaction chamber associated with one of the control pins is applied the loading pressure of a cylinder, and a reaction pressure varied depending on the velocity of a vehicle is applied to the reaction chamber associated with the other control pin.

Thus, in the proposed valve, the pressures applied to the two reaction chambers provided at both ends of the spool are different from each other, so that a load acting on the spool is biased. The application of such biased load to the spool causes the spool to carry out a twisting action at the contact region between the spool and a valve body to increase the friction therebetween. Such an increase in friction results in the responsibility of the valve being deteriorated.

SUMMARY OF THE INVENTION

The present invention has been made in view of the foregoing disadvantages of the prior art.

Accordingly, it is an object of the present invention to provide a solenoid valve which is capable of keeping a control pressure applied to an actuator such as a cylinder or the like constant to a degree sufficient to stabilize the responsibility of the solenoid valve, irrespective of a variation in flow demand of the actuator, temperature of oil or the like.

It is another object of the present invention to provide a solenoid valve which is capable of preventing a load applied to a spool from being biased, to thereby smoothly operate the spool.

In accordance with the present invention, a solenoid valve is provided. The solenoid valve includes a valve body, a spool slidably arranged in the valve body and proportional solenoids each including a push rod. The push rod of each of the proportional solenoids is positioned at an end of the spool. The proportional solenoids each are excited to change over the spool to communicate one of actuator ports with a pump and communicate the other actuator port with a tank.

The solenoid valve of the present invention generally constructed as described above is featured in that a plurality of reaction chambers are arranged on both sides of the spool in the axial direction of the spool and at equal intervals in the circumferential direction of the spool, control pins are so arranged that the inner end of each of the pins is positioned in the reaction chamber and the outer end thereof is contacted with the valve body, and passages are formed in the spool for communicating the reaction chambers to the actuator ports when the spool is changed over from a neutral position.

In the solenoid valve of the present invention constructed as described above, when the proportional solenoid is excited, the loading pressure of an actuator at this time acts on the reaction chambers. Thus, the pressure of the reaction chamber is varied depending on the loading pressure of the actuator. This permits the changing-over position of the spool to be automatically controlled depending on the loading pressure of the actuator, even when the excitation current of the proportional solenoid is rendered constant. Thus, in the solenoid valve of the present invention, the changing-over position of the spool is controlled depending on the loading pressure of the actuator, so that when, for example, the flow demand of the actuator is increased to decrease the loading pressure, the stroke of the spool is automatically adjusted correspondingly, resulting in a control pressure acting on the actuator being kept constant.

Thus, the solenoid valve of the present invention permits the amount of changing-over of the spool to be automatically adjusted depending on the loading pressure of the actuator, accordingly, the control pressure is constantly kept constant irrespective of a variation in flow demand of the actuator or temperature of oil. Such constant keeping of the control pressure permits the responsibility between the operation of the solenoid valve and the operation of the actuator to be kept constant.

Also, in the present invention, a plurality of the reaction chambers are formed in parallel to the axis of the spool and at equal intervals in the circumferential direction of the spool, resulting in balancing reaction forces acting on the reaction chambers. Accordingly, the present invention effectively prevents biasing of a load applied to the spool which causes the slide or contact region between the spool and the valve body to be twisted.

BRIEF DESCRIPTION OF THE DRAWINGS

These and other objects and many of the attendant advantages of the present invention will be readily appreciated as the same becomes better understood by reference to the following detailed description when considered in connection with the accompanying drawings; wherein.

DETAILED DESCRIPTION OF THE PREFERRED EMBODIMENT

Now, a solenoid valve according to the present invention will be described hereinafter with reference to FIGS. 1 to 3.

Figure 1:
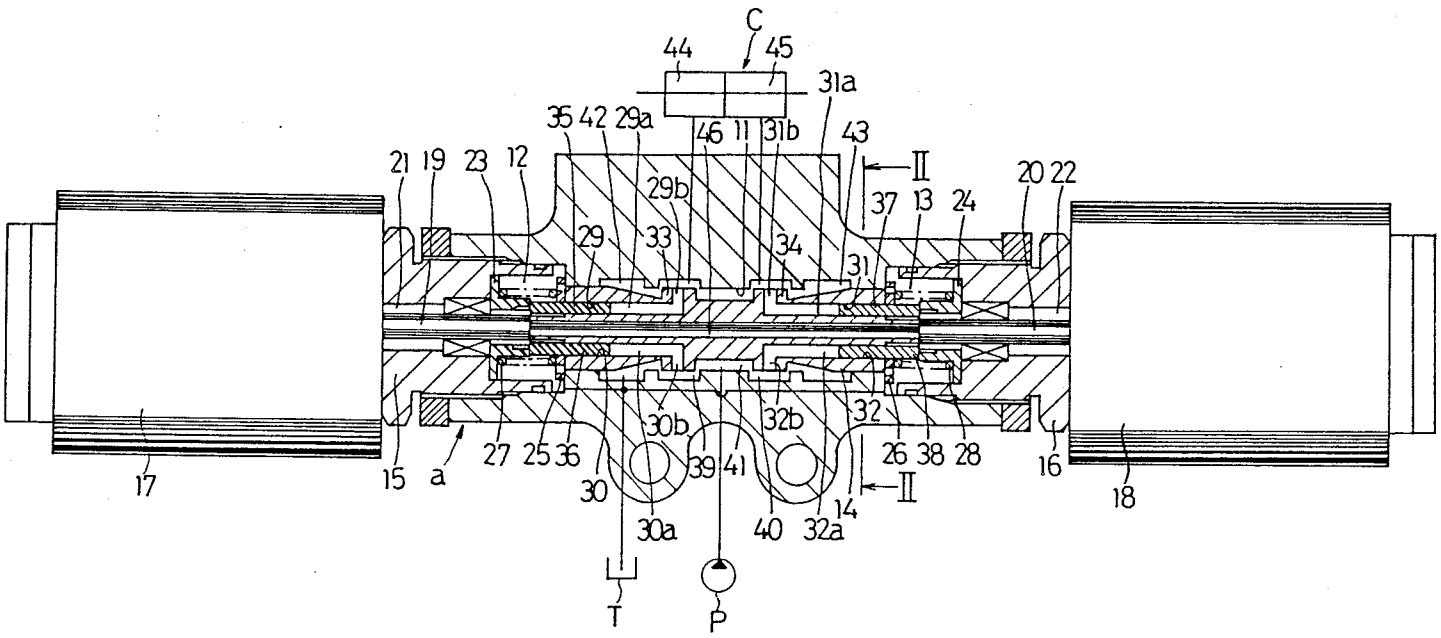
FIG. 1 is a vertical sectional view showing an embodiment of a solenoid valve according to the present invention.
Figure 4:
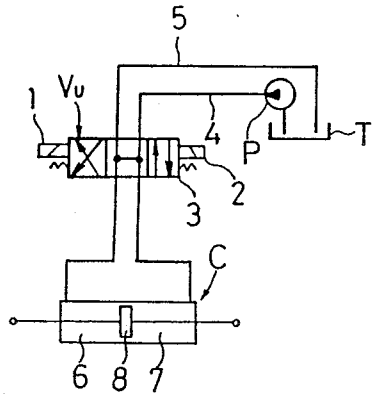
FIG. 4 is a circuit diagram showing a circuit of a conventional solenoid valve.
Figure 3:
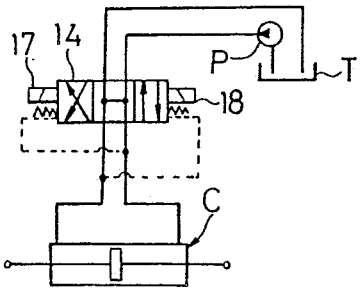
FIG. 3 is a circuit diagram showing a circuit of the solenoid valve shown in FIG. 1.
Figure 2:
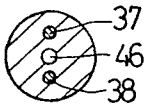
FIG. 2 is a sectional view taken along line II—II of FIG. 1.
Figure 6:
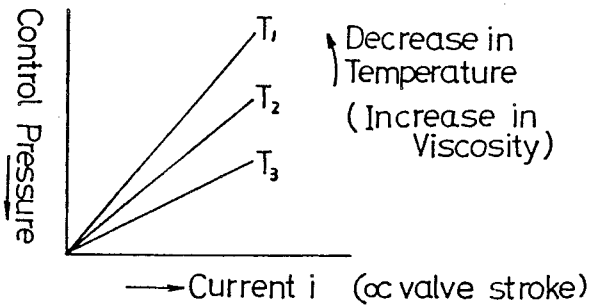
FIGS. 5 and 6 each are a graphical representation showing the relationship between the stroke of a spool and a control pressure.
Figure 5:
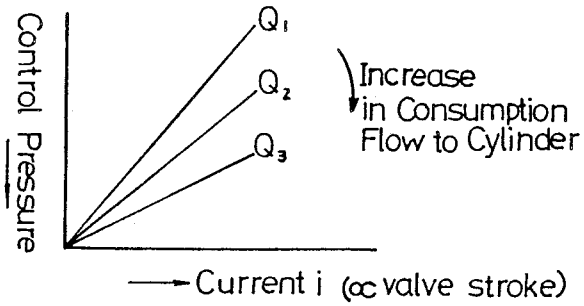

FIGS. 1 to 3 shows an embodiment of a solenoid valve according to the present invention. A solenoid valve of the illustrated embodiment includes a valve body a which is formed with a spool hole 11 extending along the central axis thereof. At both ends of the spool hole 11 are formed spring chambers 12 and 13.

In the so-formed spool hole 11 is slidably fitted a spool 14, of which both ends are arranged in the spring chambers 12 and 13. In the spring chambers 12 and 13 are threadedly fitted connection members 15 and 16 to close the spring chambers 12 and 13, respectively.

The connection members 15 and 16 are provided with proportional solenoids 17 and 18 and the connection members 15 and 16 are formed with guide holes 21 and 22, respectively. The proportional solenoids 17 and 18 include push rods 19 and 20, which are arranged so as to extend through the guide holes 21 and 22 of the connection members 15 and 16 to the spring chambers 12 and 13, respectively.

In the spring chamber 12 are arranged a first spring sheet 23 and a second spring sheet 25 in a manner to face the connection member 15 and spool 14, respectively. Likewise, in the spring chamber 13 are arranged a first spring sheet 24 and a second spring sheet 26 so as to face the connection member 16 and the spool 14, respectively. Between the first spring sheet 23 and the second spring sheet 25 is interposedly arranged a centering spring 27 and between the first spring sheet 24 and the second spring sheet 26 is interposed a centering spring 28.

The spool 14 is formed on the left side thereof with at least two pin holes 29 and 30 extending in the axial direction thereof. In the illustrated embodiment, the pin holes 29 and 30 are arranged at equal intervals in the circumferential direction of the spool 14. Likewise, it is formed on the right side thereof with at least two pin holes 31 and 32 extending in the axial direction in a similar manner. Each of the pin holes 29 and 30 is outwardly bent at the inner end thereof in a direction perpendicular to the axial direction, resulting in being open at a land 33 of the spool 14. Likewise, the pin holes 31 and 32 each are outwardly bent at the inner end thereof in a direction perpendicular to the axial direction, resulting in being open at a land 34 of the spool 14.

In the so-constructed pin holes 29 to 32 are arranged control pins 35 to 38 in a manner to be slidable therein, respectively. The control pins 35 and 36 each have an outer end extending through the second spring sheet 25 into the spring chamber 12 and abutting against the first spring sheet 23. Likewise, the control pins 37 and 38 each have an outer end extending through the second spring sheet 26 into the spring chamber 13 and abutting against the first spring sheet 24.

Also, the pin holes 29 to 32 is so constructed that the portions **29*a* to 32*a* of the pin holes 29 to 32 defined inwardly of the control pins 35 to 38 function as reaction chambers and the portions 29*b* to 32*b* of the pin holes 29 to 32 outwardly extending at a right angle from the portions 29*a* to 32*a*** function as passages.

The lands 33 and 34 are constructed so as to be kept at an under-lap state with respect to cylinder ports 39 and 40 formed at the valve body a when the spool is at a neutral position, respectively.

When the spool 14 is at a neutral position shown in FIG. 1, a pump port 41 communicates with tank ports 42 and 43, resulting in oil discharged from a pump P flowing to a tank T.

When the proportional solenoid 17 which is one of the proportional solenoids is excited, the push rod 19 pushes the spool 14 to move it against the centering spring 28. Such movement of the spool 14 causes the actuator port 39 and tank port 42 to communicate with each other, as well as the communication between the pump port 41 and the actuator port 40. This results in oil discharged from the pump P being supplied to a right-side chamber 45 of a cylinder C and working fluid in a left-side chamber 44 of the cylinder C being returned to the tank T. In this instance, the blocking is not fully carried out corresponding to the above-described under lap, depending on the amount of movement of the spool 14, so that a part of oil discharged from the pump P is returned from the tank port 43 to the tank T. Thus, it will be noted that the solenoid valve of the illustrated embodiment permits the flow rate of oil to the cylinder C to be controlled depending on the amount of movement of the spool 14 or an excitation current supplied to the proportional solenoid.

The changing-over of the spool 14 thus carried out causes the cylinder C to be actuated. At this time, the loading pressure of the cylinder C is guided through the passages **31*b* and 32*b* to the reaction chambers 31*a*** and 32*a*, resulting in acting on the control pins 37 and 38, respectively.

When the pressure thus acts on the control pins 37 and 38, the control pins necessarily abut against the first spring sheet 24, so that the pressures or forces acting on the control pins 37 and 38 each act as a reaction force in the direction of movement of the spool 14 with respect to the spool 14. The magnitude of the reaction force is represented by a formula $(P_1 \times 2A)+F$, wherein $P_1$ is a loading pressure of the cylinder C, A is a pressure receiving area of the control pin, and F is an elastic force of the centering spring 28.

Thus, the reaction force corresponding to the loading pressure of the cylinder C acts on the spool 14, accordingly, the spool 14 is moved to a position at which the balance between the pressing force of the push rod 19 determined depending on the excitation current of the proportional solenoid 17 and the reaction force determined depending on the loading pressure of the cylinder C is accomplished.

Accordingly, when a control pressure acting on an actuator is low as compared with the excitation current of the proportional solenoid 17, the reaction force is decreased correspondingly. This causes the pressing force of the push rod to overcome the reaction force to further move the spool 14, so that the feed rate to the actuator may be increased to increase the control pressure.

When the control pressure is high as compared with the excitation current, the reaction force overcomes the pressing force of the push rod, to thereby forcedly return the spool 14. This causes the feed rate to the actuator to be decreased, resulting in the control pressure being decreased.

When the other proportional solenoid 18 is excited, the spool 14 is moved in the left-hand direction in FIG. 1. This causes pressure oil to be supplied to the left-side chamber 44 of the cylinder C. The manner of the control is substantially the same as in the excitation of the proportional solenoid 17 described above.

The spool 14, as shown in FIG. 2, is formed with a though-hole 46 extending along the central axis thereof, which serves to communicate the spring chambers 12 and 13 with each other. Such construction for carrying out the communication between the spring chamber 12 and the spring chamber 13 is employed in view of a variation in volume of each of the spring chambers 12 and 13.

In the illustrated embodiment, first spring sheets 23 and 24 function as stoppers for the control pins 35 to 38 as well.

While a preferred embodiment of the invention has been described with a certain degree of particularity with reference to the drawings, obvious modifications and variations are possible in the light of the above teachings. It is therefore to be understood that within the scope of the appended claims, the invention may be practiced otherwise than as specifically described.

What is claimed is:

1. A solenoid valve comprising:

a valve body;

a spool slidably arranged in said valve body;

proportional solenoids each including a push rod, said push rod of each of said proportional solenoids being positioned at an end of said spool;

said proportional solenoids each being excited to change over said spool to communicate one of plural actuator ports with a pump and communicate the other actuator port with tank;

a plurality of reaction chambers arranged on each side of said spool in the axial direction of said spool and at equal intervals in the circumferential direction of said spool;

control pins each having an inner end positioned in said reaction chamber and an outer end contacted with said valve body; and passages formed in said spool for communicating said reaction chambers with said actuator ports when said spool is changed over from a neutral position.

* * * * *